US005890836A

United States Patent [19]

Leech

[11] Patent Number: 5,890,836

[45] Date of Patent: Apr. 6, 1999

[54] INTERLOCKING BLOCKS FOR STREAM EROSION CONTROL

[75] Inventor: James R. Leech, Vicksburg, Miss.

[73] Assignee: The United States of America as represented by the Secretary of the Army, Washington, D.C.

[21] Appl. No.: 929,911

[22] Filed: Sep. 15, 1997

[51] Int. Cl.[6] ..... E02B 3/12; E01C 5/00

[52] U.S. Cl. ..... 405/16; 405/20; 405/21; 404/34; 404/41; 404/37

[58] Field of Search ..... 405/16, 19, 20, 405/21, 30, 40, 41; 404/34, 37, 38, 39, 40, 41, 42

[56] References Cited

U.S. PATENT DOCUMENTS

| | | | |
|---|---|---|---|
| 3,931,700 | 1/1976 | Scanni et al. | 404/41 X |
| 4,227,829 | 10/1980 | Landry, Jr. | 405/20 |
| 4,372,705 | 2/1983 | Atkinson | 405/19 |
| 4,436,447 | 3/1984 | Crowe | 405/16 |
| 4,474,504 | 10/1984 | Whitman et al. | 405/16 |
| 4,875,803 | 10/1989 | Scales | 405/19 X |
| 4,998,844 | 3/1991 | Mouton et al. | 405/21 |
| 5,114,270 | 5/1992 | Riddle | 405/15 |
| 5,277,514 | 1/1994 | Glickman | 404/41 |
| 5,409,325 | 4/1995 | Wu | 404/34 |
| 5,429,451 | 7/1995 | Pettee, Jr. | 405/16 X |
| 5,556,228 | 9/1996 | Smith | 405/16 |

*Primary Examiner*—Tamara Graysay
*Assistant Examiner*—Jong-Suk Lee
*Attorney, Agent, or Firm*—Luther A. Marsh

[57] ABSTRACT

Interlocking blocks for the stabilization of stream and river banks and coast lines, road bed embankments, and boat ramps, are made of concrete, and have a high proportion of open area. Interlocking connections between adjacent blocks are made by radial projecting members and recesses on the periphery of each block, the projecting members of one block fitting into the recesses on adjacent blocks. Projections and recesses are alternately provided at regular angular intervals such that blocks can be assembled in either square or an equilateral triangular patterns. A layer of filter cloth material is laid on the sloping surface and upon which the blocks are then placed; this filter cloth slows down the leaching of water through the open areas between the interlocking blocks and prevents the washing away of sand and silt by stream or river water or rainwater runoff.

16 Claims, 4 Drawing Sheets

INTERLOCKING BLOCKS FOR STREAM EROSION CONTROL

GOVERNMENT INTEREST STATEMENT

The invention described herein may be manufactured, licensed, and used by or for governmental purposes without the payment of any royalties thereon.

BACKGROUND OF THE INVENTION

1. Field of Invention

This invention relates to interlocking concrete blocks used to reduce erosion of the banks of streams and rivers, of coast lines, and of roadbed embankments and boat ramps.

2. Prior Art

Blocks for stabilizing the banks of streams and rivers and of coast lines are known to the art. U.S. Pat. No. 4,436,447 discloses concrete blocks for erosion control which interlock by spigots and slots. U.S. Pat. No. 4,998,844 discloses shallow truncated concrete cones with interlocking wave blocks. U.S. Pat. No. 5,114,270 discloses interlocking erosion barrier blocks made of a water-permeable polymeric fiber matrix.

There is a need for improved means of erosion control along stream and river banks, along shorelines, and on sloping surface such as roadbed embankments and boat ramps. The present invention provides means of erosion control that seeks to fill this need.

SUMMARY OF THE INVENTION

The present invention provides interlocking blocks for the stabilization of stream and river banks and coast lines, road bed embankments, and boat ramps, made of concrete, and having a high proportion of open area. The interlocking connections between adjacent blocks are made by radial projecting members and recesses on the periphery of each block, the projecting members of one block fitting into the recesses on adjacent blocks. The radial projecting members widen with increasing radial distance from the center of each block. The recesses widen with decreasing radial distance from the center of each block. This feature locks the blocks together. Projections and recesses are alternately provided at regular angular intervals, e.g., 60 or 90 degrees, such that blocks can be assembled in either a square or an equilateral triangular pattern. Open areas at the center of the blocks and between adjacent blocks serve two purposes: (1) to minimize the lift created by flowing stream or river water, or by rainwater runoff, tending to disrupt the assembly of interlocking blocks placed on a sloping surface, and (2) to provide openings within which the root systems of small plants can develop, thereby allowing the growth of vegetation, which provides protection against the washing away of sand and silt by the action of moving water.

An additional feature of the present invention is the use of a layer of filter cloth material, which is laid on the sloping surface and upon which the blocks are then placed; this filter cloth slows down the leaching of water through the open areas between the interlocking blocks and prevents the washing away of sand and silt by stream or river water or by rainwater runoff.

The blocks are flat circular discs made of cement, placed on the filter cloth in a square or equilateral triangular pattern. Sections of several blocks may be preassembled by being tied together with steel bars, such as concrete reinforcing bars, hooked to eye hooks in the cement blocks, or with steel wire rope hooked to eye hooks.

DESCRIPTION OF THE PREFERRED EMBODIMENTS OF THE INVENTION

The interlocking erosion control blocks of this invention are flat circular discs made of cement, or fired clay, with diameters ranging from about 8"(20 cm) to about 24"(60 cm), and a height ranging from about 3"(7.5 cm) to about 6"(15 cm). A diameter of about 16"(40 cm) and a height of about 4"(10 cm) is preferred.

A central opening is provided in each block. Its shape is not critical; however, a generally circular shape is preferred. The major dimensions of the central opening range from about 25 to about 40% of the diameter of the block.

Figure 1A:
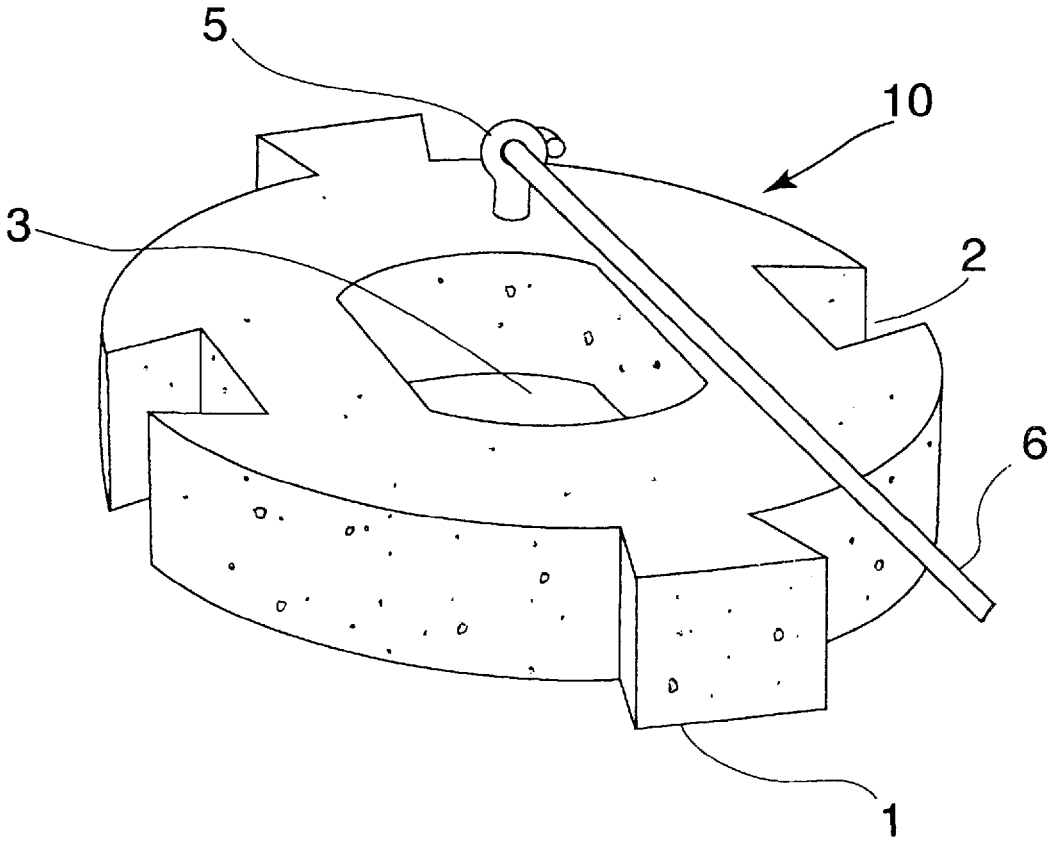
FIG. 1A shows a perspective view of a block in accordance with this invention.
Figure 2:
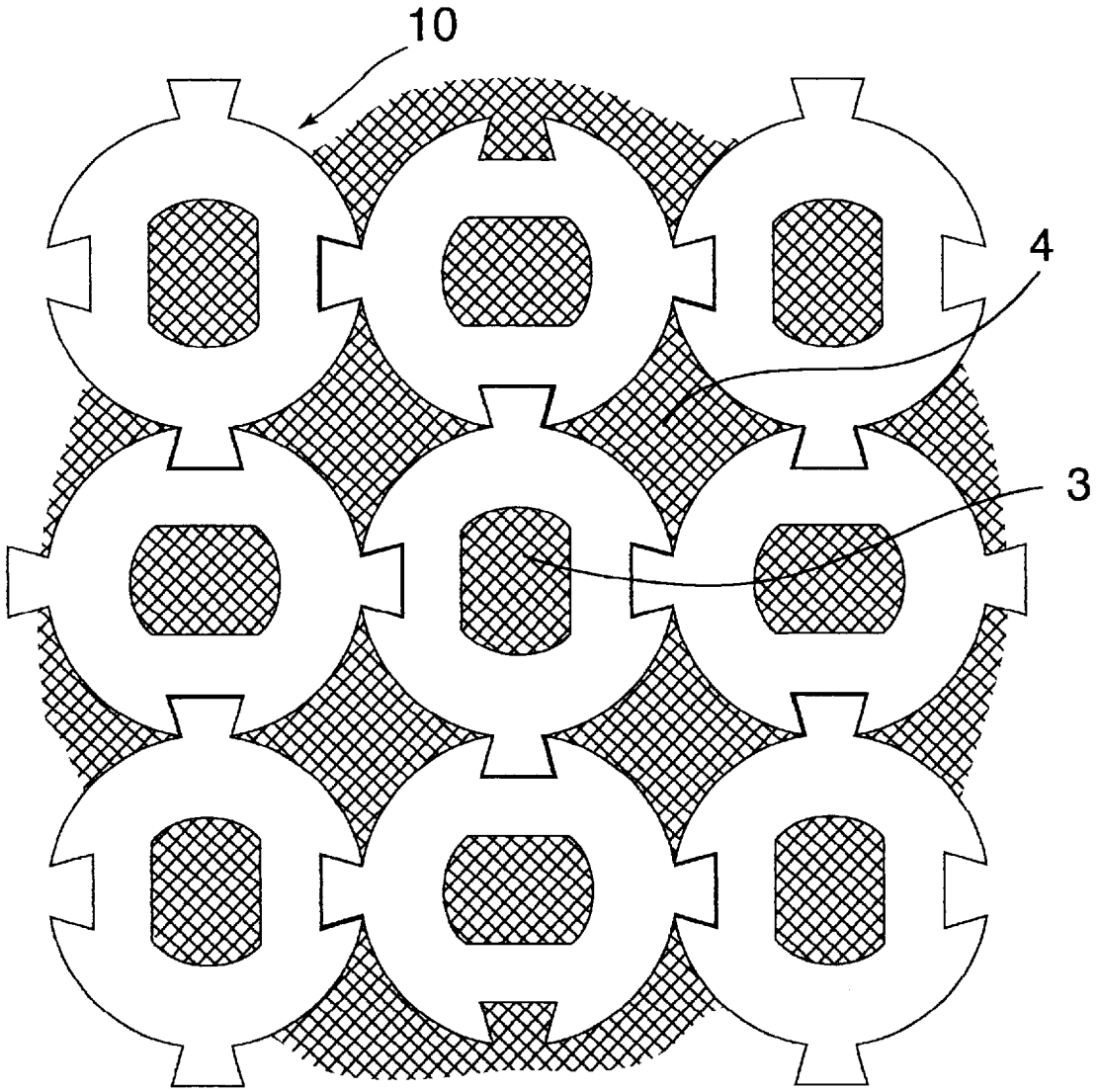
FIG. 2 shows a portion of an assembly of interlocking blocks.

The interlocking connections between adjacent blocks are made by radial projecting members and recesses on the periphery of each block, the projecting members of one block fitting into the recesses on adjacent blocks. The radial projecting members widen with increasing radial distance from the center of each block. The recesses widen with decreasing radial distance from the center of each block. This feature locks the blocks together. Projections and recesses are alternately provided at regular angular intervals of 90 degrees, such that blocks can be assembled in a square pattern. With reference to FIG. 1A, radially projecting members 1 of block 10 are provided 180 degrees apart, and recesses 2 are provided 180 degrees apart and offset with respect to the projections by 90 degrees. Interlocking connections between adjacent blocks are made by placing the radially projecting members on the periphery of each block into the recesses on adjacent blocks. A central opening, 3 is provided FIG. 2 illustrates a portion of a system of interlocking blocks as used to construct the erosion control barriers of this invention wherein the blocks are on square centers.

Figure 1B:
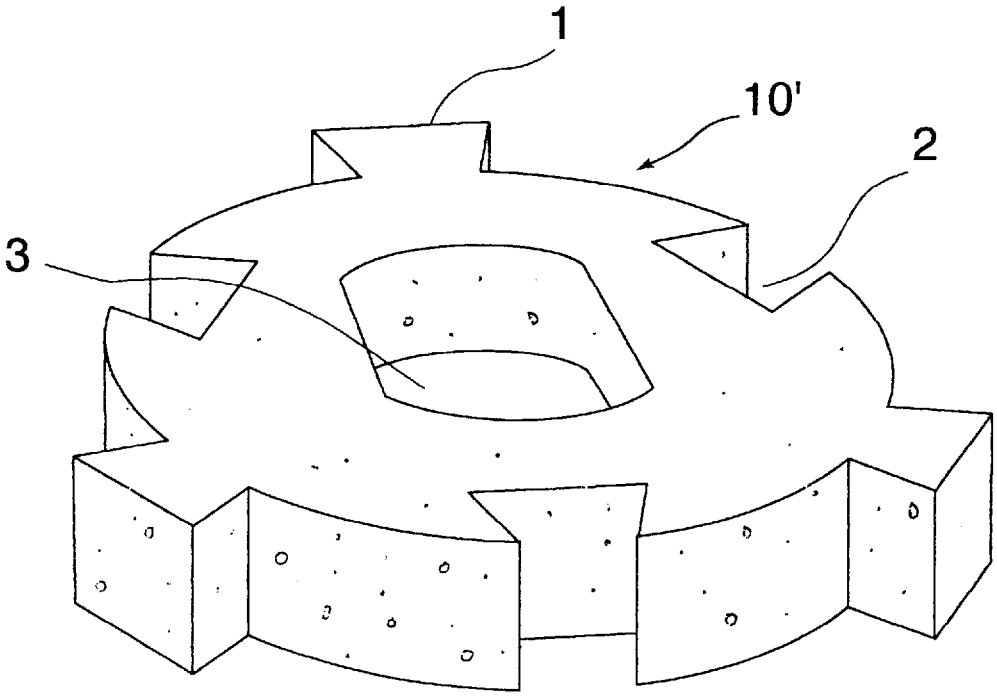
FIG. 1B shows an alternative embodiment of 1A.
Figure 3:
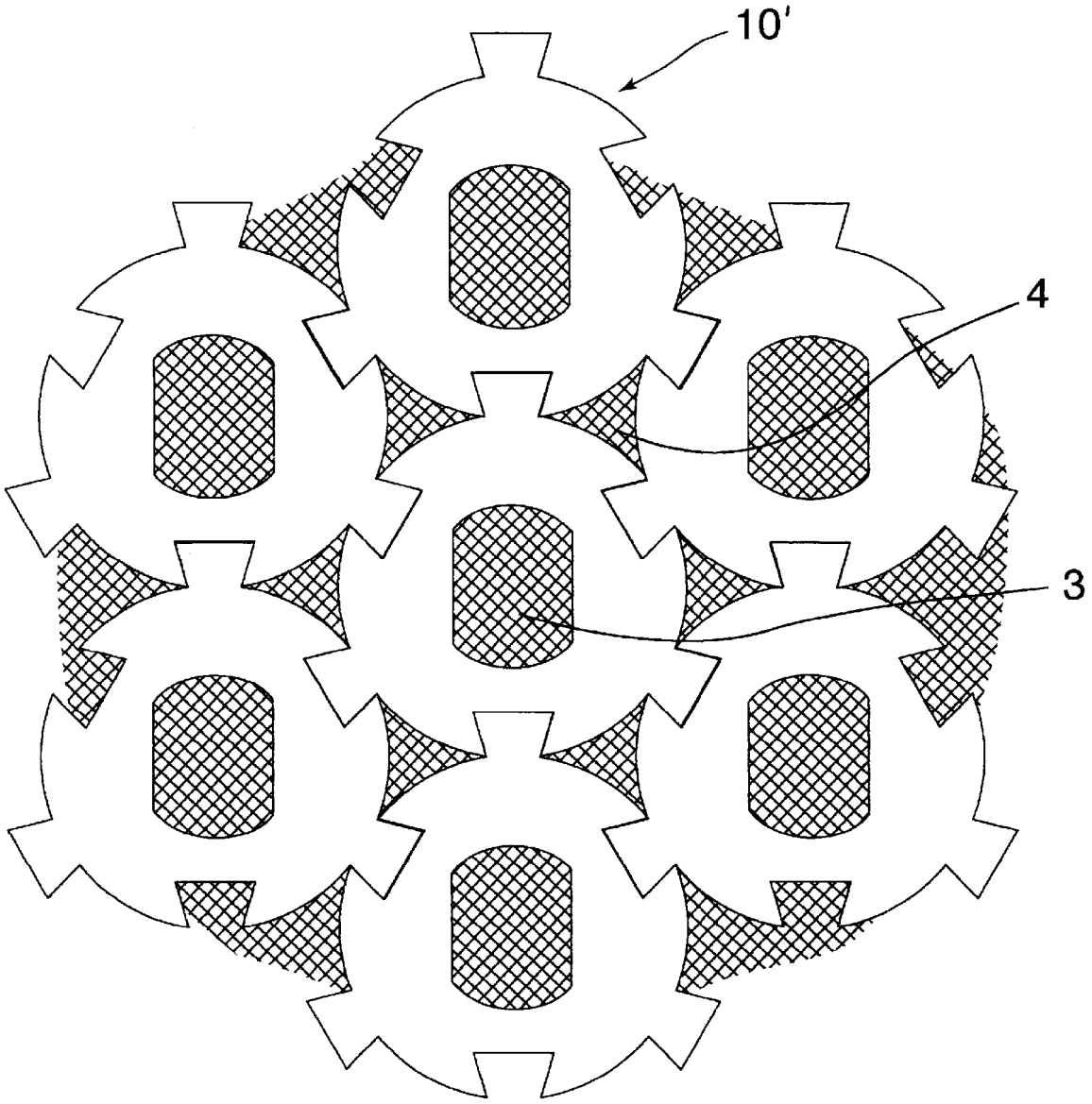
FIG. 3 shows a portion of an assembly of interlocking blocks of an alternative embodiment of FIG. 2.

Alternatively, the blocks, 10' may have alternating projecting members and recesses at 60 degree intervals as shown in FIG. 1B. Such blocks may be assembled into a system of interlocking blocks as shown in FIG. 3 wherein these are on equilateral triangular centers. The square pattern is generally preferred over the equilateral triangular pattern because it provides more open space between blocks for the growth of vegetation.

The interlocking blocks are placed on a filter cloth, 4, that controls the rate of water infiltration into the soil under the erosion barrier. The filter cloth 4, as shown in FIG. 2 and FIG. 3 may be woven or nonwoven and made of natural or synthetic material. Cotton or linen cloth may be expected to rot in the course of time. Polyethylene or polypropylene fiber cloth may be expected to be more durable. The permeability of the filter cloth, defined as the water penetration rate per unit of cross sectional area per unit of hydrostatic driving force, is selected for each field application on the basis of expected stream water flow rate or rainfall.

Sections of several blocks may be preassembled by being tied together with steel bars 6, as shown in FIG. 1A such as concrete reinforcing bars, hooked to eye hooks 5, as shown in FIG. 1A in the cement blocks, or with steel wire rope.

The foregoing is considered as illustrative of the principles of this invention. Numerous modifications and changes may occur to those skilled in the art. It is not desired to limit the invention to the exact construction as shown and described. Accordingly, all suitable modifications fall within the scope of this invention.

What is claimed is:

1. An erosion control block in the shape of a circular disk comprising a plurality of projecting members and recesses regularly spaced, alternately along the periphery of said disk at predetermined angular intervals, said alternating projecting members fitting into recesses in adjacent blocks for interlocking the blocks with the adjacent blocks adapted to form a stream erosion control barrier, wherein the width of said projecting member increases continuously with increasing the radial distance from the center of the block, and the width of said recess increases continuously with decreasing the radial distance from the center of the block.

2. The block of claim 1 wherein the alternating recesses and projecting members are spaced 90 degrees apart.

3. A barrier made of a plurality of blocks in accordance with claim 2 wherein the blocks are arranged in a square pattern.

4. A barrier for controlling erosion of river banks comprising a plurality of interlocking blocks in accordance with claim 2 and a filter cloth adapted to be disposed between said blocks and the banks.

5. The block of claim 1 wherein the alternating recesses and projecting members are spaced 60 degrees apart.

6. The block of claim 5 further comprising a central opening having a diameter ranging from 25 percent to 40 percent of the diameter of the circular disk.

7. The barrier for controlling erosion of river banks comprising a plurality of interlocking blocks in accordance with claim 6 and a filter cloth adapted to be disposed between the blocks and the banks.

8. A barrier for controlling erosion of river banks comprising a plurality of interlocking blocks in accordance with claim 5 and a filter cloth adapted to be disposed between said blocks and the banks.

9. A barrier made of a plurality of blocks in accordance with claim 5 wherein the blocks are arranged in an equilateral triangular pattern.

10. The block of claim 1 having an opening at the center thereof, wherein the major dimension of the opening ranges from 25 to 40% of the diameter of the block.

11. A barrier for controlling erosion of river banks comprising a plurality of interlocking blocks in accordance with claim 6 and a filter cloth adapted to be disposed between said blocks and the banks.

12. A barrier made of a plurality of blocks in accordance with claim 10 further comprising means disposed thereon for tying the blocks together.

13. A barrier in accordance with claim 12 wherein the tying means includes eye hooks and steel concrete reinforcing rods.

14. The block of claim 1, made of cement.

15. The block of claim 1, made of fired clay.

16. A barrier for controlling erosion of river banks comprising a plurality of interlocking blocks in accordance with claim 1 and a filter cloth adapted to be disposed between said blocks and the banks.

* * * * *